US008588636B2

(12) United States Patent
Iwanami et al.

(10) Patent No.: US 8,588,636 B2
(45) Date of Patent: Nov. 19, 2013

(54) IMAGE FORMING APPARATUS

(75) Inventors: Toru Iwanami, Ebina (JP); Naoya Yamasaki, Ebina (JP); Wenxiang Ge, Ebina (JP); Gen Nakajima, Ebina (JP); Kenjo Nagata, Ebina (JP); Hidefumi Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 260 days.

(21) Appl. No.: 13/098,790

(22) Filed: May 2, 2011

(65) Prior Publication Data

US 2012/0070164 A1 Mar. 22, 2012

(30) Foreign Application Priority Data

Sep. 17, 2010 (JP) ..... 2010-209372

(51) Int. Cl.
*G03G 15/10* (2006.01)

(52) U.S. Cl.
USPC ..... 399/63; 399/27

(58) Field of Classification Search
USPC ..... 399/27, 63
See application file for complete search history.

(56) References Cited

U.S. PATENT DOCUMENTS

| | | | | |
|---|---|---|---|---|
| 5,031,123 | A * | 7/1991 | Narukawa | 399/59 |
| 5,160,968 | A * | 11/1992 | Yamada et al. | 399/63 |
| 2006/0159474 | A1 * | 7/2006 | Suzuki et al. | 399/27 |
| 2009/0208234 | A1 * | 8/2009 | Takahashi et al. | 399/63 |

FOREIGN PATENT DOCUMENTS

JP 02-221980 A 9/1990

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

An image forming apparatus includes: an image carrier; an image-forming device including a toner and forming a toner image on the image carrier during a first running period; a detector detecting a toner quantity in a set period within the first running period; and a toner supplying device supplying the image-forming device with a toner according to the detected toner quantity. The apparatus further includes a period setting device that causes the image-forming device to stir the toner over a second running duration longer than the first running duration, and causes, during the second running duration, the detector to perform detection plural times over a period longer than the period, thereby measuring a result stable time required to stabilize the result of the detection, and setting in the detector, as the period, a period over which the result of the detection is stable within the first running duration.

5 Claims, 13 Drawing Sheets

IMAGE FORMING APPARATUS

CROSS-REFERENCE TO RELATED APPLICATION

This application is based on and claims priority under 35 USC 119 from Japanese Patent Application No. 2010-209372, filed Sep. 17, 2010.

BACKGROUND

Technical Field

The present invention relates to an image forming apparatus.

SUMMARY

According to an aspect of the invention, an image forming apparatus include: an image carrier on a surface of which an image is formed and carries the image; and an image-forming device that includes a toner, forms a toner image on the surface of the image carrier with the toner while stirring the toner inside the image-forming device, performs forming the toner image within a first running duration, and stops forming the toner image after the first running duration. The image forming apparatus further includes a detector, a toner supplying device and a period setting device. The detector is attached to the image-forming device, detects a quantity of the toner included in the image-forming device within the first running duration, is set with a period of detection within the first running duration, and performs detection during the period which is set. The toner supplying device supplies the image-forming device with a quantity of toner according to the quantity of the toner detected by the detector. The period setting device causes the image-forming device to stir the toner over a second running duration longer than the first running duration, and causes, during the second running duration, the detector to perform the detection plural times over a period longer than the period, to measure a result stable time required for a result of the detection by the detector to stabilize, and to set in the detector, as the period of the detection within the first running duration, a period over which the result of the detection is stable within the first running duration.

BRIEF DESCRIPTION OF THE DRAWINGS

Exemplary embodiments of the present invention will be described in detail based on the following figures, wherein.

DETAILED DESCRIPTION

An exemplary embodiment of the image forming apparatus of the present invention will be described below.

Figure 1:
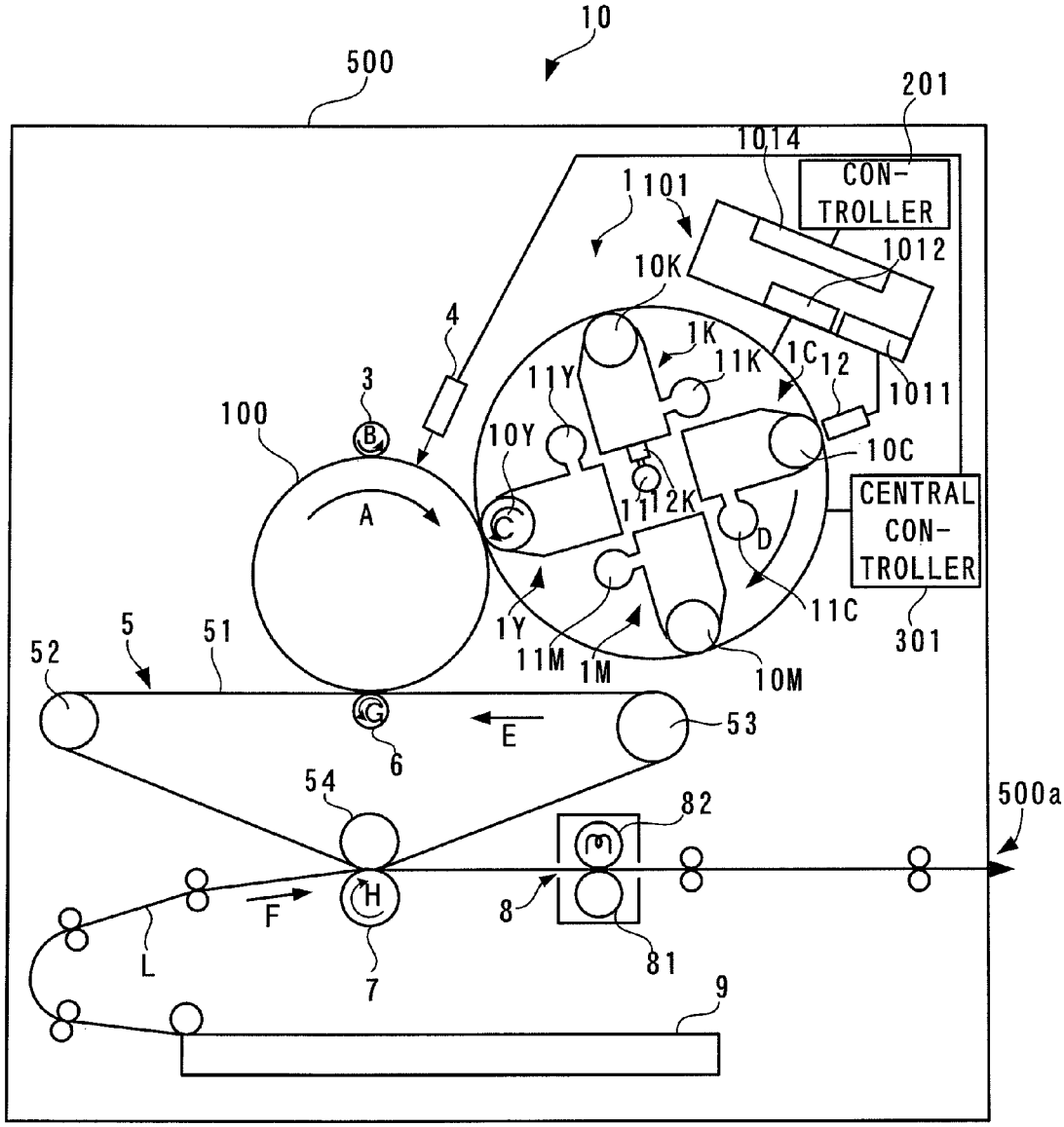
FIG. 1 is a schematic structural diagram of a printer.

FIG. 1 is a schematic structural diagram of a printer.

A printer 10 illustrated in FIG. 1 is a full color printer capable of forming a full color image on a recording medium. This printer 10 is an exemplary embodiment of the image forming apparatus of the present invention.

This printer 10 has a housing 500, and a media cassette 9 is disposed in the bottom of the housing 500. In the media cassette 9, recording media are stacked and housed.

In this printer 10, the recording media are drawn one by one from the media cassette 9, and the drawn recording media are transported along a conveyance path L. Further, in this printer 10, although the details will be described later, a toner image is formed on a photoreceptor roll 100, and the formed toner image is transferred to a surface of the recording medium being conveyed. Further, the recording medium having the transferred toner image is heated and pressurized so that the toner image is fixed to the surface of the recording medium. As a result, an image is formed on the recording medium. A medium ejection slot 500*a* is formed in the housing 500, and the recording medium with the surface to which the toner image is fixed is ejected from this medium ejection slot 500*a* to the outside of the printer 10.

The formation of the toner image, the transfer of the toner image and the fixing of the toner image in this printer 10 are performed as described below.

The photoreceptor roll 100 is provided above the media cassette 9. This photoreceptor roll 100 is a roll rotating in a direction of an arrow A and extending in a direction perpendicular to the surface of a sheet of paper of FIG. 1. The photoreceptor roll 100 is equivalent to an example of the image carrier according to the aspect of the present invention. Provided directly above this photoreceptor roll 100 is a charging roll 3. This charging roll 3 contacts the photoreceptor roll 100 rotating in the direction of the arrow A, to rotate in a direction of an arrow B by following the photoreceptor roll 100, thereby charging a surface of the photoreceptor roll 100. Above the upper right part of the photoreceptor roll 100, an exposure device 4 is provided. According to image data transmitted from a central controller 301 to be described later, the exposure device 4 exposes the electrically charged surface of the photoreceptor roll 100. As a result, an electrostatic latent image is formed on the surface of the photoreceptor roll 100. Provided on the right side of the photoreceptor roll 100 is a revolver developing unit 1.

The central controller 301 is provided on the right side of the revolver developing unit 1.

The central controller 301 controls the operation of each part of this printer 10, including the revolver developing unit 1.

The revolver developing unit 1 includes four developing devices 1Y, 1M, 1C and 1K. This revolver developing unit 1 is equivalent to an example of the rotation device according to an aspect of to the present invention, and each of these four developing devices 1Y, 1M, 1C and 1K is equivalent to an example of the image-forming device according to an aspect of to the present invention.

These four developing devices 1Y, 1M, 1C and 1K are in charge of Y (yellow) color, M (magenta) color, C (cyan) color and K (black) color, respectively, and each of the developing devices includes a toner of the color handled by the developing device and a developer containing a magnetic carrier. Further, the developing devices 1Y, 1M, 1C and 1K have development rolls 10Y, 10M, 10C and 10K, respectively.

Furthermore, the revolver developing unit 1 includes four toner supplying devices 11Y, 11M, 11C and 11K corresponding to the four developing devices 1Y, 1M, 1C and 1K, respectively. These four toner supplying devices 11Y, 11M, 11C and 11K are each equivalent to an example of the toner supplying device according to the aspect of the present invention.

Each of the toner supplying devices includes a built-in toner transport section. Specifically, this toner transport section has such a structure that a spiral fin is disposed around a rod. Further, the toner transport section rotates while receiving an ON-signal from the controller 201 and thereby replenishes the developing device with the toner. When the signal changes to OFF, the toner transport section stops rotating and also halts the replenishing of the toner.

Further, the revolver developing unit 1 has a rotation axis 11, and this rotation axis 11 is coupled to a stepping motor not illustrated. The central controller 301 controls the rotation angle of the revolver developing unit 1 in a direction of an arrow D through the stepping motor. The central controller 301 transmits the number of steps representing the rotation angle to the stepping motor, thereby causing the revolver developing unit 1 to rotate by only the angle corresponding to the number of steps. Thus, the central controller 301 causes the development roll of a desired one of the four developing devices 1Y, 1M, 1C and 1K provided in the revolver developing unit 1 to face the surface of the photoreceptor roll 100. FIG. 1 illustrates a state in which the development roll 10Y of the developing device 1Y containing the Y-color toner faces the photoreceptor roll 100.

Figure 2:
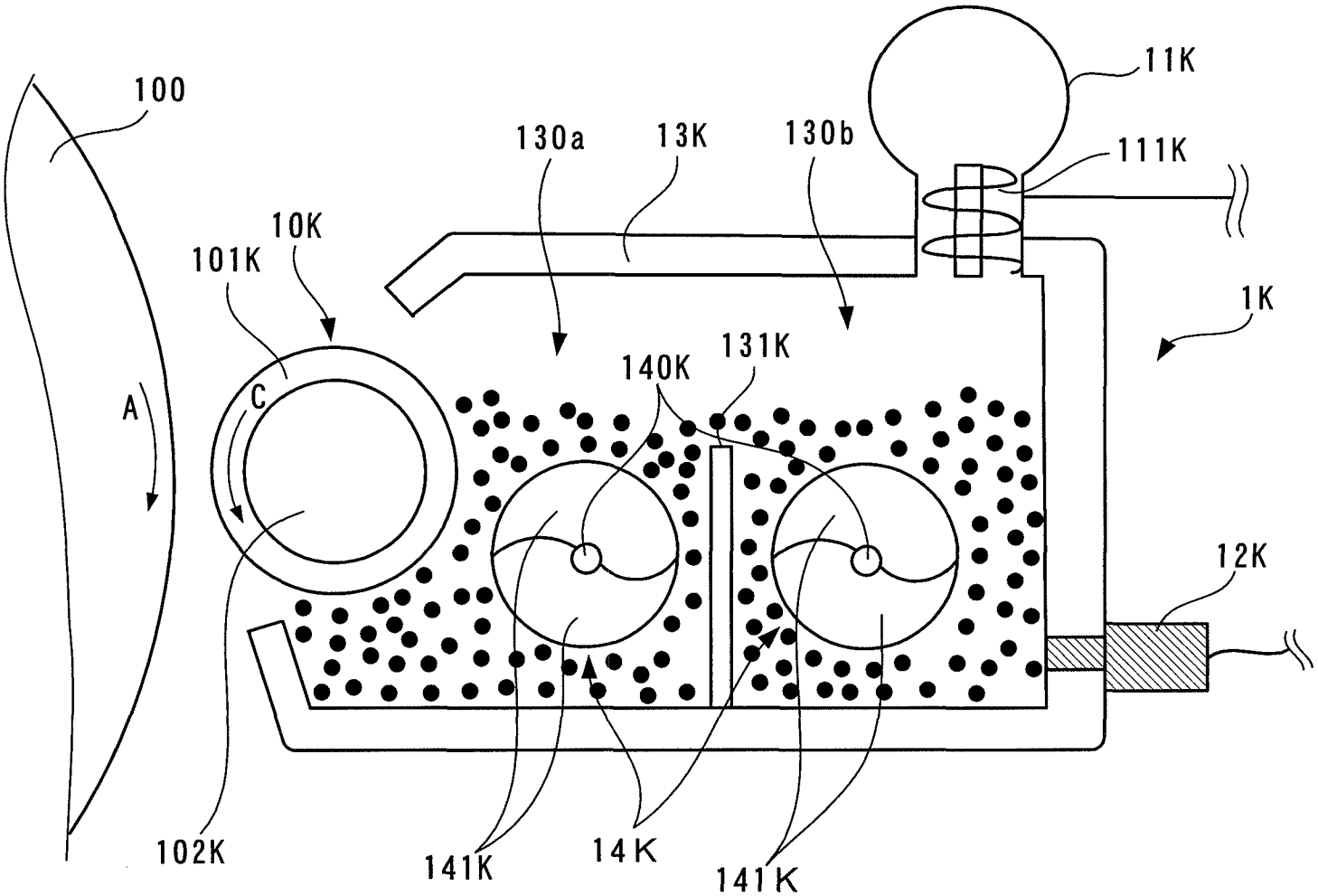
FIG. 2 is a cross-sectional view of the developing device.

FIG. 2 is a cross-sectional view of the developing device. Incidentally, here, the description will be provided by taking the developing device 1K for the K color as a representative example. This developing device 1K for the K color and the developing devices 1Y, 1M and 1C for other colors are structurally the same except that the contained colors are different.

The developing device 1K has the development roll 10K as mentioned above, and the development roll 10K has a developing sleeve 101K and a magnetic roll 102K.

The developing sleeve 101K is a hollow cylinder roll made of aluminum rotating in a direction of an arrow C. The magnetic roll 102K is fixed inside the developing sleeve 101K independently of the developing sleeve 101K. In the magnetic roll 102K, plural magnetic poles are arranged in a rotation direction of the developing sleeve 101K, and has a predetermined magnetic-force distribution that defines the adsorption and release of the developer.

Further, a voltage is applied to the development roll 10K, so that an electric potential difference is produced between the development roll 10K and the electrostatic latent image formed on the surface of the photoreceptor roll 100.

Furthermore, as described above, the developing device 1K contains the developer including the toner and the magnetic carrier in the inside of a housing 13K. The inside of the housing 13K is partitioned by a wall 131K extending in parallel with the development roll 10K. The inside of the housing 13K is partitioned by this wall 131K into a first storage chamber 130*a* next to the development roll 10K and a second storage chamber 130*b* next to this first storage chamber 130*a*.

A stirring transport member 14K is provided in each of the first storage chamber 130*a* and the second storage chamber 130*b*. The stirring transport member 14K has, specifically, such a structure that a spiral fin 141K is provided around a rod 140K. The stirring transport members 14K each provided in the first storage chamber 130*a* and the second storage chamber 130*b* are rotated in directions opposite to each other. Thus, while being stirred, the developer contained in the housing 13K is transported such that a right portion and a left portion between which the wall 131K is interposed are moved in directions opposite to each other. This causes the developer to circulate around the wall 131K. Inside the housing 13K, the toner and the magnetic carrier are stirred by the stirring transport member 14K and thereby, the toner and the magnetic carrier are charged to be opposite to each other in polarity and adsorb each other. As a result, inside the housing 13K, the toner and the magnetic are mixed in harmony.

The developing sleeve 101K rotating in the direction of the arrow C is supplied with the developer in the housing by the magnetic-force distribution of the magnetic roll 102K disposed inside, and transports the developer to a part between the developing sleeve 101K and the photoreceptor roll 100. The voltage is applied to the development roll 11K as mentioned earlier, and an electric field is formed with the exposure by the exposure device 14 between the electrostatic latent image on the surface of the photoreceptor roll 100 and the development roll 10K facing the photoreceptor roll 100. The toner electrostatically adhering to the magnetic carrier is transferred to the electrostatic latent image due to this electric field, and the electrostatic latent image is developed with the toner. As a result, the toner image is formed on the photoreceptor roll 100, and the photoreceptor roll 100 carries the toner image on the surface. The developer away from the position opposite the photoreceptor roll 100 is released in the housing by the magnetic-force distribution of the magnetic roll 102K.

Further, FIG. 2 illustrates a toner transport section 111K of the toner supplying device 11K. As described earlier, the toner transport section 111K has such a structure that the spiral fin is provided around the rod.

Furthermore, FIG. 2 illustrates a permeability sensor 12K detecting the permeability of the developer contained in the developing device 1K for the K color. Because of a reason to be described later, only the developing device 1K for the K color detects the toner quantity of the developer by using the permeability sensor 12K. The toner quantities of the developers for the colors other than the K color are detected by using an optical sensor 12 illustrated in FIG. 1.

The description will be continued by returning to FIG. 1.

As described earlier, the central controller 301 provided in the printer 10 receives the image data transmitted externally, separates the received image data into pieces of color data of Y color, M color, C color and K color, and transmits the pieces of color data to an the exposure device 4.

This printer 10 is provided with the controller 201, the optical sensor 12 and the permeability sensor 12K. Although the detail will be described later, in this printer 10, the toner density of the developer contained in each of the four developing devices 1Y, 1M, 1C and 1K is controlled, by using the optical sensor 12, the permeability sensor 12K and the like.

Provided below the photoreceptor roll 100 is an intermediate transfer unit 5. This intermediate transfer unit 5 has an intermediate transfer belt 51. The intermediate transfer belt 51 is an endless belt that circularly moves along a predetermined path in a direction of an arrow E, and the toner image held on the surface of the photoreceptor roll 100 is transferred to the surface of the intermediate transfer belt 51. The intermediate transfer belt 51 is held around three rolls 52, 53 and 54 to be described later.

Further, the intermediate transfer unit 5 has a primary transfer roll 6. The primary transfer roll 6 is disposed opposite the photoreceptor roll 100 over the intermediate transfer belt 51 interposed in between, and moves in a direction of an arrow G by following the circularly moving of the intermediate transfer belt 51 in the direction of the arrow E. Therefore, the primary transfer roll 6 rotates in the direction of the arrow G, while holding the intermediate transfer belt 51 interposed between the primary transfer roll 6 and the photoreceptor roll 100 carrying the toner image on the surface. Further, a potential of the polarity opposite to the polarity of the charged toner is given to the primary transfer roll 6. For this reason, the toner image formed on the surface of the photoreceptor roll 100 is attracted by the primary transfer roll 6 electrostatically. As a result, the toner image is transferred to the surface of the intermediate transfer belt 51 circularly moving in the direction of the arrow E.

Further, the intermediate transfer unit 5 has the drive roll 52, the tension roll 53 and the opposite roll 54, and as mentioned earlier, the intermediate transfer belt 51 is held around these three rolls.

The drive roll 52 rotates by obtaining a rotation driving force from a driving source not illustrated. Thus, the intermediate transfer belt 51 circularly moves in the direction of the arrow E. The tension roll 53 and the opposite roll 54 rotate by following the circularly moving of the intermediate transfer belt 51 in the direction of the arrow E. Incidentally, the opposite roll 54 faces a secondary transfer roll 7 to be described later, across the intermediate transfer belt 51 interposed in between, and aids the secondary transfer of the toner image, which has been transferred to the surface of the intermediate transfer belt 51, to the recording medium.

The secondary transfer roll 7 is disposed below the intermediate transfer unit 5, across the conveyance path L of the recording medium interposed in between. The potential of the polarity opposite to the polarity of the toner is given to the secondary transfer roll 7. The secondary transfer roll 7 rotates in a direction of an arrow H, by following the circularly moving of the intermediate transfer belt 51 in the direction of the arrow E. The recording medium is drawn out from the media cassette 9 comes along the conveyance path L. The recording medium and comes in between the secondary transfer roll 7 and the intermediate transfer belt 51 having the toner image held on the surface. As a result, the toner image after transferred to the surface of the intermediate transfer belt 51 is transferred to the recording medium.

Disposed on the right side of the secondary transfer roll 7 is a fuser 8. The fuser 8 has a pressure roll 81 and a heating roll 82. The pressure roll 81 and the heating roll 82 rotate to heat and pressurize the recording medium while holding therebetween the recording medium having the transferred toner image and conveyed in a direction of an arrow F. As a result, the toner image transferred to the recording medium is fused and fixed onto the recording medium by being pressed against the recording medium, and thereby the image is formed on the recording medium.

Here, an operation of forming the full color image in the printer 10 having the revolver developing unit 1 will be briefly described. In this printer 10, the full color image is formed by forming, at first, a Y-color toner image, and subsequently by forming an M-color toner image, a C-color toner image and a K-color toner image, sequentially.

In this printer 10, at first, the charging roll 3 charges the surface of the photoreceptor roll 100 rotating in the direction of the arrow A, and the central controller 301 transmits image data for the Y color among the image data separated into the pieces for the respective colors of Y, M, C and K to the exposure device 4. The exposure device 4 starts the exposure according to the image data for the Y color, with timing when the charged part of the surface of the photoreceptor roll 100 by the charging roll 3 arrives. As a result, an electrostatic latent image for the Y color is formed on the surface of the photoreceptor roll 100. In timing for the formation of the electrostatic latent image for the Y color, the central controller 301 causes the revolver developing unit 1 to rotate, so that the development roll 10Y faces the photoreceptor roll 100. This allows the developing device 1Y for the Y color to develop the electrostatic latent image for the Y color with the Y-color toner. Subsequently, the Y-color toner image is transferred to the surface of the intermediate transfer belt 51 by the primary transfer roll 6.

Next, of the photoreceptor roll 100, the part after finishing the transfer of the Y-color toner image is charged by the charging roll 3 again. The central controller 301 next transmits the image data for the M color to the exposure device 4. The exposure device 4 exposes the charged surface of the photoreceptor roll 100 according to this image data for the M color, and thereby an electrostatic latent image for the M color is formed on the surface of the photoreceptor roll 100. In timing for the formation of the electrostatic latent image for the M color, the central controller 301 causes the revolver developing unit 1 to rotate, so that the development roll 10M of the developing device 1M for the M color faces the photoreceptor roll 100. This allows the developing device 1M for the M color to develop the electrostatic latent image for the M color with the M-color toner. The Y-color toner image after transferred to the intermediate transfer belt 51 has been already moved in the direction of the arrow E. However, the secondary transfer by the secondary transfer roll 7 is not carried out, and the Y-color toner image comes again to where the primary transfer roll 6 is located, so that the M-color toner image is transferred onto the Y-color toner image. Afterwards, the above-described cycle is repeated also for each of the C color and the K color, and thereby the toner images of the four colors are laminated on the intermediate transfer belt to be a layered toner image. The layered toner image after the transfer of the last K-color toner image is transferred onto the recording medium by the secondary transfer roll 7. Subsequently, the layered toner image after transferred onto the recording medium is fixed onto the recording medium by the fuser 8.

Here, a method of controlling the toner density of each of the four developing devices 1Y, 1M, 1C and 1K will be described.

This printer 10 includes, as mentioned earlier, the optical sensor 12 and the permeability sensor 12K.

This optical sensor 12 is fixedly disposed outside the revolver developing unit 1, and detects the toner quantity of the developer contained in each of the developing devices 1Y, 1M and 1C in charge of the Y, M and C colors except the K color among the four colors.

This optical sensor 12 has a light-emitting section and a light-receiving section, although the illustration is omitted. The optical sensor 12 emits, with the light-emitting section, a predetermined amount of light toward the development rolls 10Y, 10M and 10C each carrying the developer on the surface. Further, this optical sensor 12 receives, with the light-receiving section, the light reflected upon and coming back from the development rolls 10Y, 10M and 10C each carrying the developer on the surface, and the optical sensor 12 outputs an analog signal corresponding to the amount of the received light. The analog signal outputted by the optical sensor 12 is sent to an analog-to-digital converter (this analog-to-digital converter will be hereinafter referred to as an A/D converter) 101. When a change occurs in the toner quantity of the developer contained in each of the developing devices 1Y, 1M and 1C, the toner quantity of the developer held on the surface of each of the development rolls 10Y, 10M and 10C also changes, causing a change in the amount of the reflected light.

The A/D converter 101 has first and second detecting sections 1011 and 1012 that detect the analog signal. The analog signal transmitted from the optical sensor 12 is sampled by the first detecting section 1011 of these two detecting sections.

The first detecting section 1011 samples the analog signal transmitted from the light-receiving section of the optical sensor 12 and reflecting the toner quantity in each of the developing devices in charge of the Y, M and C colors except for the K color of the four colors. Subsequently, the first detecting section 1011 converts the analog signal into a digital signal, and transmits the digital signal to the controller 201. Upon detecting a decrease in the toner quantity based on the transmitted digital signal, the controller 201 instructs the toner supplying devices 11Y, 11M and 11C to supply the developing devices 1Y, 1M and 1C with the toners. Incidentally, when the development roll 10Y of the developing device 1Y for the Y color faces the photoreceptor roll 100, the optical sensor 12 faces the development roll 10C of the developing device 1C for the C color and transmits the analog signal reflecting the toner quantity of the developer contained in the developing device 1C for the C color to the first detecting section 1011. Further, when the development roll 10C of the developing device 1C for the C color faces the photoreceptor roll 100, the optical sensor 12 faces the development roll 10Y of the developing device 1Y for the Y color, and transmits the analog signal reflecting the toner quantity of the developer contained in the developing device 1Y for the Y color to the first detecting section 1011.

The permeability sensor 12K is attached to the developing device 1K for the K color. The permeability sensor 12K transmits an analog signal according to the permeability of the developer contained in the developing device 1K, to the A/D converter 101 disposed outside the revolver developing unit 1, via a transmission path to be described later. In the A/D converter 101, the second detecting section 1012 of the two detecting sections samples this analog signal. When a decrease occurs in the proportion of the toner in the developer, the proportion of the magnetic carrier that is a magnetic substance increases, and thereby the permeability rises. For this reason, the analog signal outputted by the permeability sensor 12K reflects the toner quantity in the developer. The second detecting section 1012 samples the analog signal transmitted from the permeability sensor 12K, converts the analog signal into a digital signal, and transmits the digital signal to the controller 201. From this digital signal, the controller 201 recognizes the quantity of the toner contained in the developing device 1K for the K color. When recognizing a decrease in the toner quantity, the controller 201 instructs the corresponding toner supplying device 11K to supply the developing device 1K for the K color with the toner.

The reason why there is such a difference between the method of detecting the toner quantity for the K color and those of other three colors is because the magnetic carrier is black and thus, the optical sensor 12 is unable to detect fluctuations in the proportion of the K color toner contained in the developer carried by the development roll 10K for the K color.

Next, there will be described a slip ring system for transmitting the analog signal representing the permeability detected by the permeability sensor 12K to the controller 201 disposed outside the revolver developing unit 1.

Figure 3:
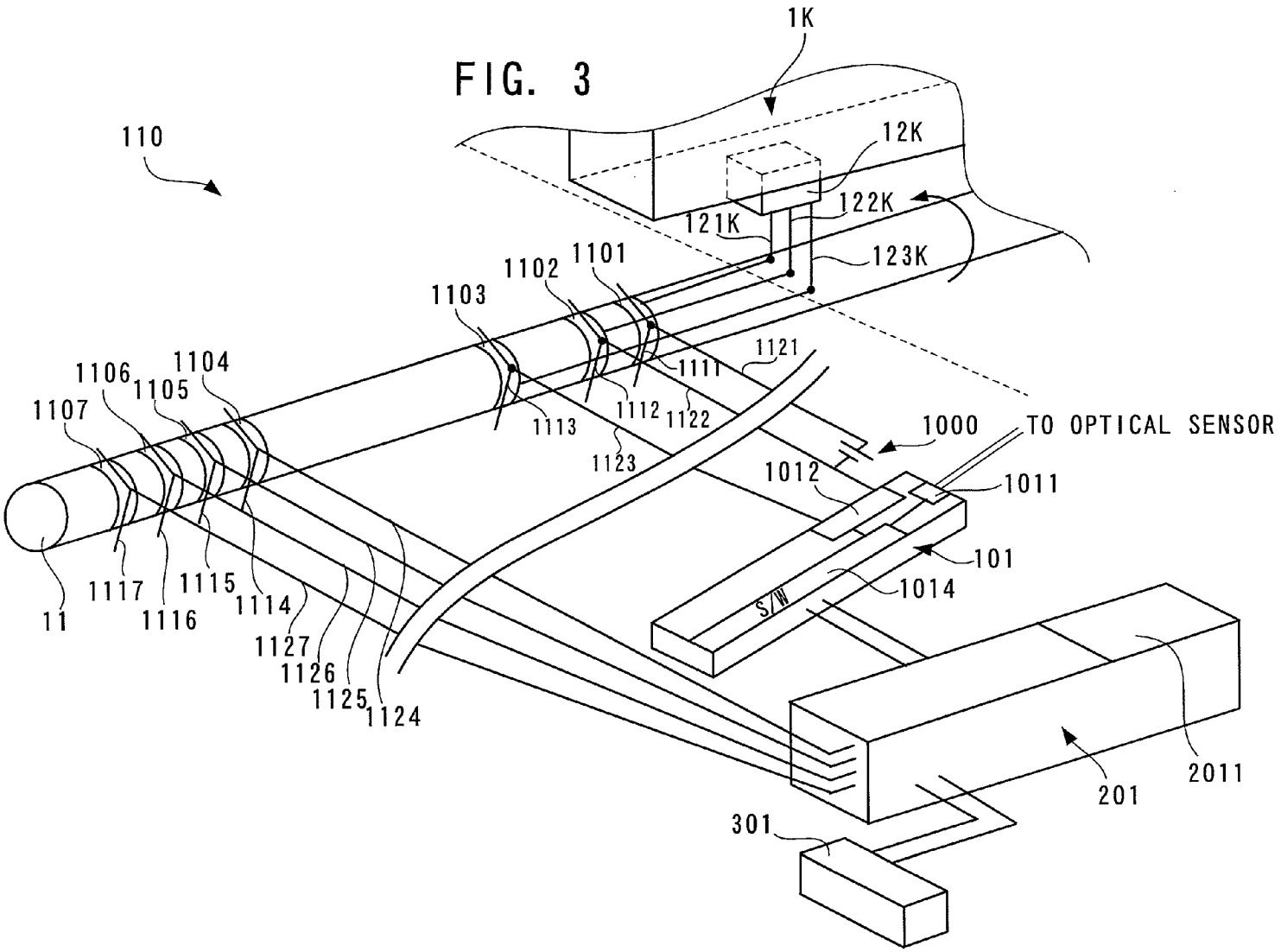
FIG. 3 is a schematic structural diagram of the slip ring system.

FIG. 3 is a schematic structural diagram of the slip ring system.

FIG. 3 illustrates the developing device 1K for the K color to which the permeability sensor 12K is attached.

The slip ring system 110 includes first to seventh slip rings 1101, 1102, 1103, 1104, 1105, 1106 and 1107. Further, the slip ring system 110 includes, as an element, the rotation axis 11 that is also an element of the revolver developing unit 1.

These first to seventh slip rings are metal rings, and the rotation axis 11 is a resin rod. These first to seventh slip rings are attached to the rotation axis 11 with space in between, and rotate with the rotation axis 11.

Further, this slip ring system 110 includes first to seventh wire brushes 1111, 1112, 1113, 1114, 1115, 1116 and 1117.

These first to seventh wire brushes are provided corresponding to the first to the seventh slip rings, and the first to the seventh slip rings and the first to the seventh wire brushes touch each other.

Furthermore, this slip ring system 110 includes first to seventh lead wires 1121, 1122, 1123, 1124, 1125, 1126 and 1127.

These first to seventh lead wires are connected to the first to the seventh wire brushes, respectively.

The first to the seventh wire brushes and the first to the seventh lead wires are fixedly disposed irrespective of the rotation of the revolver developing unit 1. However, since the first to the seventh slip rings are present on the entire circumference of the rotation axis 11, even when the first to the seventh wire brushes are disposed fixedly, the first to the seventh wire brushes constantly contact the surfaces of the slip rings rotating with the rotation axis 11, and the continuity between the first to the seventh slip rings and the first to the seventh wire brushes is maintained.

FIG. 3 illustrates only the developing device 1K for the K color for convenience of explanation, but actually, the four developing devices are disposed around the rotation axis 11. In an area above a dotted line illustrated in FIG. 3, the four developing devices disposed around the rotation axis 11 rotate with the rotation axis 11. For this reason, the wire brushes are not disposed in the area above the dotted line. On the other hand, in an area below the dotted line illustrated in FIG. 3, only the rotation axis 11 rotates even when the developing devices rotate and thus, the wire brushes are disposed fixedly.

The first slip ring 1101 is disposed at a position closest to the developing devices, and the second slip ring 1102 as well as the subsequent slip rings are disposed sequentially in a direction of going away from the developing devices.

Incidentally, in the following, a path including the first slip ring 1101, the first wire brush 1111 and the first lead wire will be referred to as a first transmission path. Similarly, second to seventh paths including the second to the seventh slip rings, the second to the seventh wire brushes and the second to the seventh lead wires will be referred to as second to seventh transmission paths, respectively.

The permeability sensor 12K has a power line 121K, a ground wire 122K and a signal line 123K. The power line 121K is connected to the first slip ring 1101, and the ground wire 122K is connected to the second slip ring 1102. Further, the signal line 123K is connected to the third slip ring 1103.

Between the first lead wire 1121 of the first transmission path and the second lead wire 1122 of the second transmission path, a first power supply 1000 is connected. This first power supply 1000 is a constant-voltage power supply, and supplies a constant voltage to the permeability sensor 12K through these first and second transmission paths.

The second lead wire 1122 of the second transmission path and the third lead wire 1123 of the third transmission path are connected to the second detecting section 1012 of the A/D converter 101, and the analog signal reflecting the toner quantity is transmitted to the second detecting section 1012 through the second and third transmission paths. Incidentally, the A/D converter 101 has a switching (S/W) system 1014, and the switching system 1014 switches the transmission of the digital signal to the controller 201 by the detecting sections.

The fourth to the seventh transmission paths including the fourth to the seventh slip springs, the fourth to the seventh wire brushes and the fourth to the seventh lead wires are transmission paths for giving toner-supply instructions from the controller 201 to the respective toner supplying devices.

In other words, the fourth to the seventh slip rings are connected to the toner supplying devices 11Y, 11M, 11C and 11K for the Y color, M color, C color and K color (see FIG. 1), respectively. On the other hand, the fourth to the seventh lead wires are connected to the controller 201.

In the controller 201, the toner density in each of the developing devices is recognized: for the K color, based on the digital signal obtained by sampling the analog signal outputted from the permeability sensor 12K in the second detecting section 1012; and for other colors, based on the digital signal obtained by sampling the analog signal from the optical sensor 12 in the first detecting section 1011. To the developing device requiring the toner supplying, an ON signal is transmitted by using the fourth to the seventh transmission paths. Incidentally, this controller 201 has a storage section 2014 that will be described later in detail.

Incidentally, in a general printer having a revolver developing device, even during the formation of an image, for each developing device whose development roll does not face the photoreceptor roll, driving of a development roll and a stirring transport member is stopped for the purpose of suppressing waste power consumption or other reasons. Then, in the developing device whose development roll does not face the photoreceptor roll, a developer is unevenly distributed in the gravity direction while the driving of the stirring transport member is stopped. Ina case where the toner quantity of the developer contained in a housing is detected with a permeability sensor, a detection signal greatly fluctuates when the posture of the housing or movement of the developer changes. For this reason, the permeability, which is detected at the time when the development roll faces the photoreceptor roll 100 and the stirring transport member in the housing is driven, correctly reflects the toner quantity of the developer contained in the developing device. Therefore, in order to obtain a permeability that correctly reflects the toner quantity of the developer contained in the developing device disposed in the revolver developing device, at least the development roll needs to face the photoreceptor roll, and the driving of the stirring transport member needs to be started.

However, although the driving of the stirring transport member is started, considering that the developer has been unevenly distributed in the gravity direction by then, the permeability obtained immediately after the initiation of the driving of the stirring transport member is unlikely to reflect the toner quantity of the developer contained in the developing device.

Thus, it is conceivable to control the toner density based on a detected value, which is obtained after a lapse of predetermined time during which the permeability is assumed to stabilize, after the development roll is caused to face the photoreceptor roll and the driving of the stirring transport member is started. The time to wait in this way will be hereinafter referred to as "measurement-start waiting time."

However, the time required for the detected value to stabilize is affected by an individual difference due to a state of attaching the sensor to the developing device or hardware of the developing device, the amount of the developer, or the temperature and humidity, and thus is not constant.

Thus, in this printer 10, the "measurement-start waiting time" is updated regularly as described below. In addition, sampling of a toner-density detected value for the K color is performed in the timing based on the "measurement-start waiting time." On the other hand, as for the developing devices 1Y, 1M and 1C for the colors except the K color, the toner quantity is optically detected for the developer held by the development roll and thus, there is obtained a detection result that correctly reflects the toner quantity of the developer regardless of the positional change of the developing device or the stirring state of the developer in the housing. Therefore, as for the sampling of the density detected value of the toner of the colors except the K color, there is no need to devise the timing particularly, and the sampling is performed appropriately.

In the following, before the description of processing of determining the "measurement-start waiting time" in the developing device 1K for the K color in this printer 10 (this processing will be hereinafter referred to as "second TC measurement processing"), there will be first described sampling processing of the analog signal representing the permeability in the A/D converter 101, which is performed after the lapse of this "measurement-start waiting time" (this sampling processing will be hereinafter referred to as "first TC measurement processing").

Figure 4:
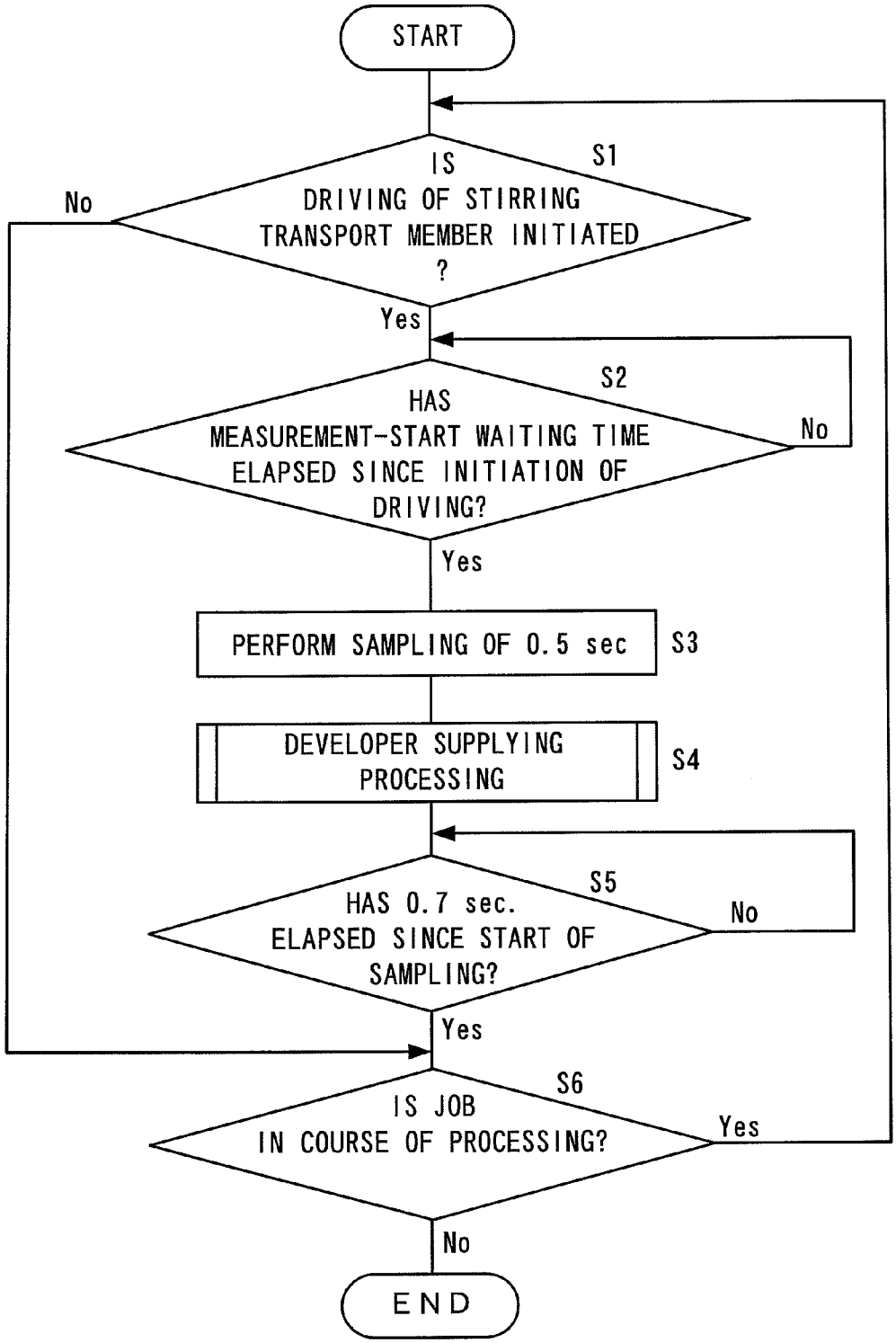
FIG. 4 is a flowchart of the "first TC measurement processing"

FIG. 4 is a flowchart of the "first TC measurement processing."

A routine represented by the flowchart in FIG. 4 is executed in the "first TC measurement processing", and activated in this printer 10 when running of a job including printing operation of forming the toner image of the K color is started.

In step S1, it is determined whether the stirring transport member 14K built in the developing device 1K for the K color is activated to form the toner image for the K color in the job.

When it is determined that the stirring transport member 14K is activated in step S1, the flow proceeds to step S2 in which it is determined whether time T that is the currently set "measurement-start waiting time" has elapsed since the activation of the stirring transport member 14K. In step S2, the flow stands by until the "measurement-start waiting time" elapses. After the lapse of the "measurement-start waiting time", the flow proceeds to step S3 in which sampling of the analog value (voltage value) transmitted from the second detecting section 1012 is performed for 0.5 seconds in the A/D converter 101. The A/D converter 101 transmits data resulting from this sampling to the controller 201. This A/D converter 101 is equivalent to an example of the detector according to the aspect of the present invention. The controller 201 recognizes the toner quantity of the developer contained in the developing device 1K for the K color based on the transmitted data.

In step S4, a "developer supplying processing" subroutine is performed, and a to-be-supplied toner quantity according to the recognized toner quantity is determined. Subsequently, an order of supplying the toner is issued to the toner supplying device 11K.

In step S5, it is determined whether 0.2 s that is "time between measurements" has elapsed since the completion of the sampling. In step S5, the flow stands by until this "time between measurements" passes, and when it is determined that this "time between measurements" has passed, the flow proceeds to step S6.

In step S6, it is determined whether the job is still in the course of processing, and if the job is in the course of processing, the flow returns to step S1 in which it is determined whether the driving of the stirring transport member 14K built in the developing device 1K for the K color is still continued. When it is determined that the driving is still continued in step S1, the "measurement-start waiting time" in step S2 has already passed and thus, the flow proceeds to step S3. In step S3, the second sampling for 0.5 seconds begins. However, when the driving of the stirring transport member 14K stops during the sampling, the sampling also stops. In this printer 10, after the lapse of the "measurement-start waiting time", the sampling for 0.5 seconds is repeated if time permits, and an instruction corresponding to the toner quantity detected at that time is transmitted to the toner supplying device 11K. Incidentally, in step S1, when the driving of the stirring transport member 14K built in the developing device 1K for the K color is yet to start or has completed already, the flow proceeds to step S6. When it is determined that the job is completed in step S6, this routine is terminated. Now, an example of the timing of the sampling in the first TC measurement processing will be described.

Figure 5:
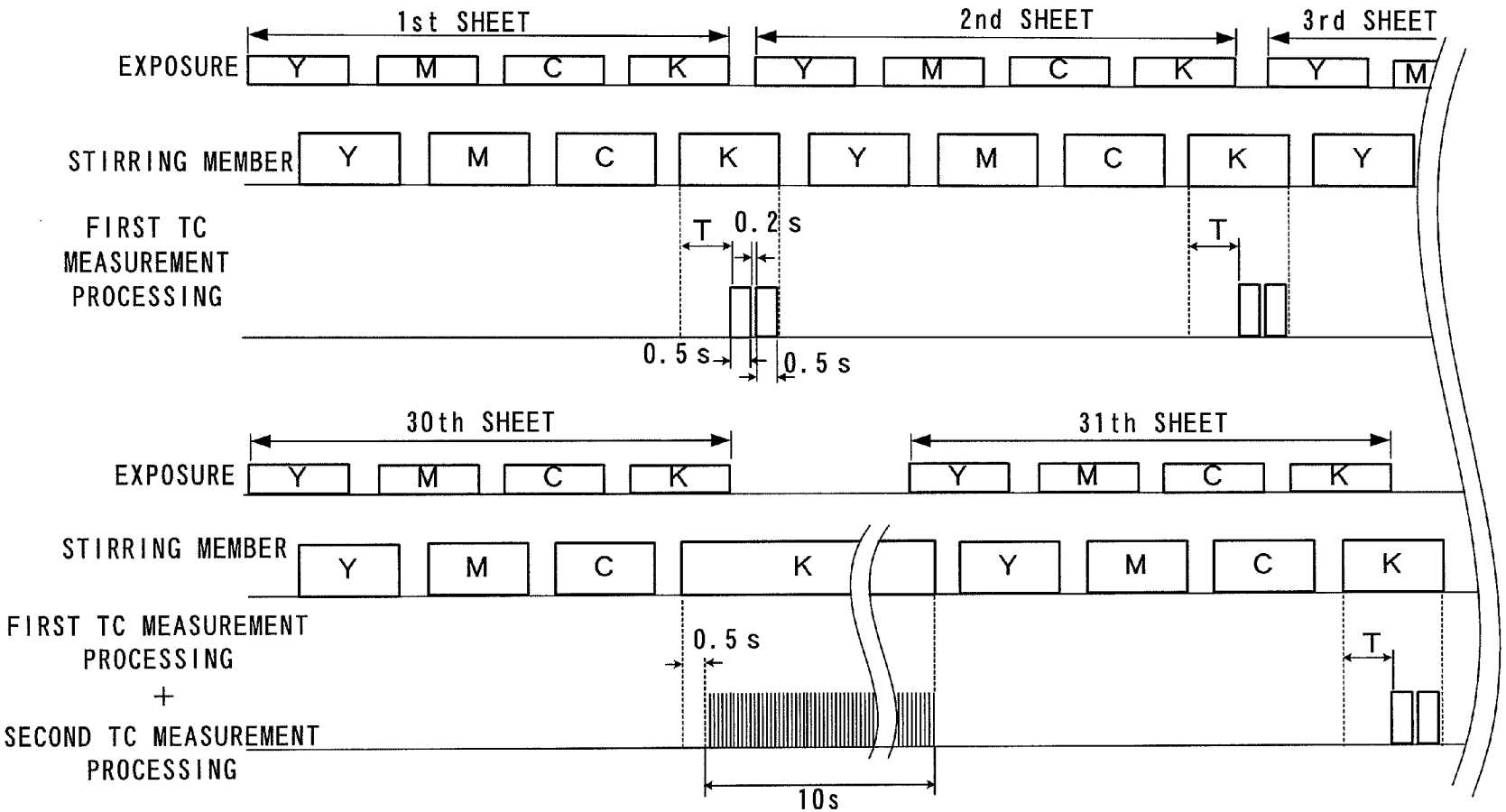
FIG. 5 is a time chart of the sampling in the first TC measurement processing.

FIG. 5 is a time chart of the sampling in the first TC measurement processing.

Illustrated in the uppermost stage of FIG. 5 is the timing of activating and stopping the exposure device at the time of forming the electrostatic latent image for each of the Y, M, C and K colors. The revolver developing device 1 rotates in the direction of the arrow D illustrated in FIG. 1 as described earlier and thus, when the full color image is formed, the exposure is performed for the Y, M, C and K colors in this order. Here, there is illustrated the timing of activating and stopping the exposure device at the time of forming the electrostatic latent image for each color, for printing of first to third sheets immediately after the job is started.

Illustrated in the second stage of FIG. 5 is the timing of activating and stopping the stirring transport member disposed in each of the developing devices of the Y, M, C and K colors. Here, there is illustrated a state in which the activating and stopping of the stirring transport member of each of the developing devices for the Y, M, C and lastly K colors is performed a little later than the exposure.

Illustrated in the third stage of FIG. 5 is a state in which after the time T that is the currently set "measurement-start waiting time" has elapsed since the activation of the stirring transport member 14K disposed in the developing device 1K for the K color, the sampling of the analog signal representing the permeability for 0.5 seconds is performed twice at an interval of 0.2 seconds, in the second detecting section 1012 of the A/D converter 101 illustrated in FIG. 3.

In this printer 10, each time the full color printing is performed, for the developing device 1K of the K color, after the lapse of the time T that is the currently set "measurement-start waiting time", the sampling of the analog signal for 0.5 seconds is performed in the second detecting section 1012 as many time as possible until the stirring of the developer of the K color is finished, and the toner density is controlled based on the data resulting from the sampling. This concludes the description of the "first TC measurement processing." The "second TC measurement processing" will be described next.

Figure 6:
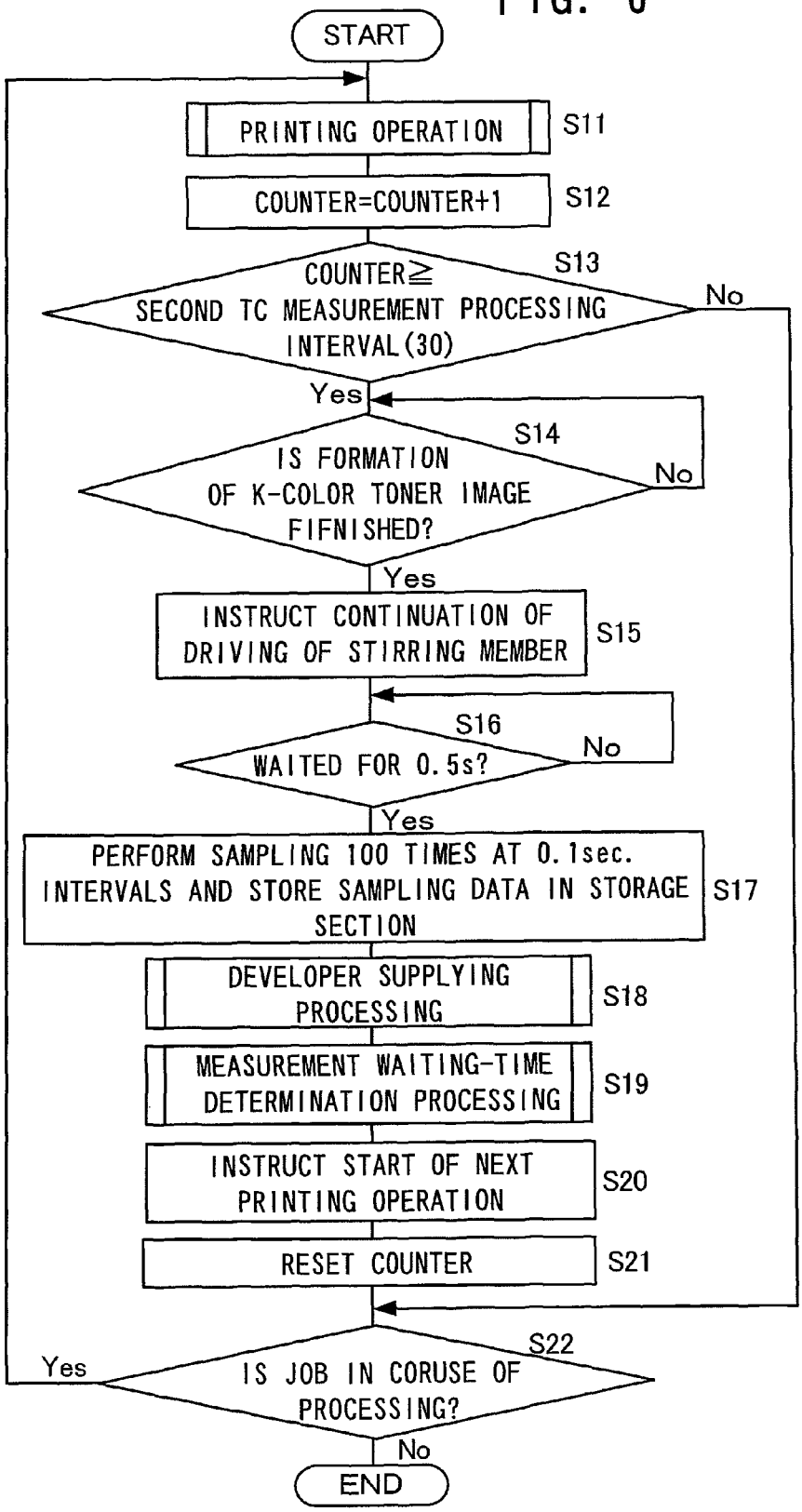
FIG. 6 is a flowchart of the "second TC measurement processing"

FIG. 6 is a flowchart of the "second TC measurement processing."

A routine represented by the flowchart in FIG. 6 is executed in the "second TC measurement processing." This flowchart indicates that the "second TC measurement processing" updating the "measurement-start waiting time" is performed once, every time printing of, for example, 30 sheets is completed.

In step S11, a "printing operation" subroutine following the start of the job and provided to control each functional part of the printer is executed. In this "printing operation" subroutine, printing is performed, but this printing is not directly related to the present invention and thus will not be further described.

In step S12, 1 is added to the number counted by a counter counting the number of printed sheets.

In step S13, it is determined whether the number counted by the counter exceeds a "second TC measurement processing interval" (for example, 30). In other words, it is determined whether the printing operation of, for example, the 30th sheet, which is the timing of performing the "second TC measurement processing", has started or not. When it is determined that the printing operation has started in step S13, the flow proceeds to step S14 where the "second TC measurement processing" begins. During the printing operation, the "first TC measurement processing" is not performed, and this "second TC measurement processing" is executed.

In step S14, it is determined whether the formation of the toner image for the K color in the printing operation is finished or not. In step S14, the process stands by until the formation of the toner image for the K color is finished. When it is determined that the formation of the toner image for the K color is finished, the flow proceeds to step S15 in which there is issued an instruction of causing the charging roll 3 to charge the photoreceptor roll 100 and the driving of the stirring transport member 14K for the K color to continue, but prohibiting the exposure. In other words, although the details will be described later, the next toner-image formation is delayed to secure a long time during which the permeability correctly reflects the toner quantity of the developer contained in the developing device 1K for the K color. In the next step S16, it is determined whether the standby time of 0.5 s has elapsed. In step S16, the process stands by until this standby time passes, and proceeds to step S17 after the lapse of the standby time. In step S17, in the A/D converter 101, the sampling of the analog value transmitted to the second detecting section 1012 for 0.1 seconds is repeated 100 times (this sampling repeated 100 times will be hereinafter referred to as "second TC measured value detection"). Subsequently, a value obtained by each sampling is transmitted to the controller 201. In the controller 201, sampling data (value) transmitted from the A/D converter 101 is stored in the storage section 2011 described earlier. Here, the description of the flowchart in FIG. 6 is suspended, and the timing of the sampling will be described with reference to FIG. 5.

Illustrated in the fourth stage of FIG. 5 is the timing chart of activating and stopping the exposure device at the time of forming the electrostatic latent image of each of the Y, M, C and K colors, for each of the 30th and 31st printed sheets. Here, the time interval between the 30th and 31st sheets is longer than the time interval between the first and second sheets and the time interval between the second and third sheets, due to the operation carried out in step S15 of FIG. 6.

Further, illustrated in the fifth stage of FIG. 5 is a state in which the driving time of the stirring transport member 14K for the K color in the printing of the 30th sheet is extended to be longer than that in other printing, due to the operation carried out in step S15 of FIG. 6. Furthermore, the surface of the photoreceptor roll 100 is charged by the charging roll 3, but the electrostatic latent image for the K color is not formed on the surface of the photoreceptor roll 100. As a result, the toner image is not formed and thus, there is no change in the toner quantity during the extended driving time of the stirring transport member 14K.

Illustrated in the lowermost stage of FIG. 5 is a state in which the "second TC measured value detection" is performed after the waiting time (see step S16) of 0.5 s has passed since the activation of the stirring transport member 14K disposed in the developing device 1K for the K color, in the printing operation of the 30th sheet. The time including this waiting time of 0.5 s and the time during which the "second TC measured value detection" is performed, namely, the duration of running the "second TC measured value detection", is equivalent to an example of the second running duration according to the aspect of the present invention.

Further, the lowermost stage of FIG. 5 also illustrates a state in which the "first TC measurement processing" already described above is performed after the time T that is the currently set "measurement-start waiting time (see step S16) has passed since the activation of the stirring transport member 14K disposed in the developing device 1K for the K color, in the printing operation of the 31st sheet. In this way, in the "second TC measurement processing", the "measurement waiting time" is reviewed, based on the sampling data obtained by the "second TC measured value detection" carried out every time the printing of 30 sheets is performed (these 100 pieces of sampling data will be hereinafter referred to as a "second TC measured-value group"). The description will be continued by returning to step S18 in FIG. 6.

In step S18, although the details will be described later, the "developer replenishing processing" subroutine illustrated also in step S4 of FIG. 4 is performed based on the 100th second TC measured value assumed to be most reflecting the toner quantity of the developer. Subsequently, in step S19, although this will also be described later in detail, a "measurement waiting-time determination processing" subroutine for reviewing the "measurement waiting time" is executed.

In step S20, the start of the printing of the 31st sheet is instructed, and in step S21, the counter is reset. Subsequently, the flow proceeds to step S22 in which it is determined whether the job is in the course of processing or not, and if the job is in the course of processing, the flow returns to step S11. When it is determined that the job is finished, the routine represented by the flowchart in FIG. 6 ends. Incidentally, in step S13, when it is determined that the counter is less than 30, the flow proceeds to step S22, thereby causing the counter to advance.

Next, the "measurement waiting-time determination processing" subroutine of determining the "measurement waiting time" will be described. Incidentally, assuming that the "second TC measured value detection" has been performed once before this stage, the description will be provided. Further, the storage section 2011 of the controller 201 includes a counter that indicates the number of times the "second TC measured value detection" is executed.

Figure 7A:
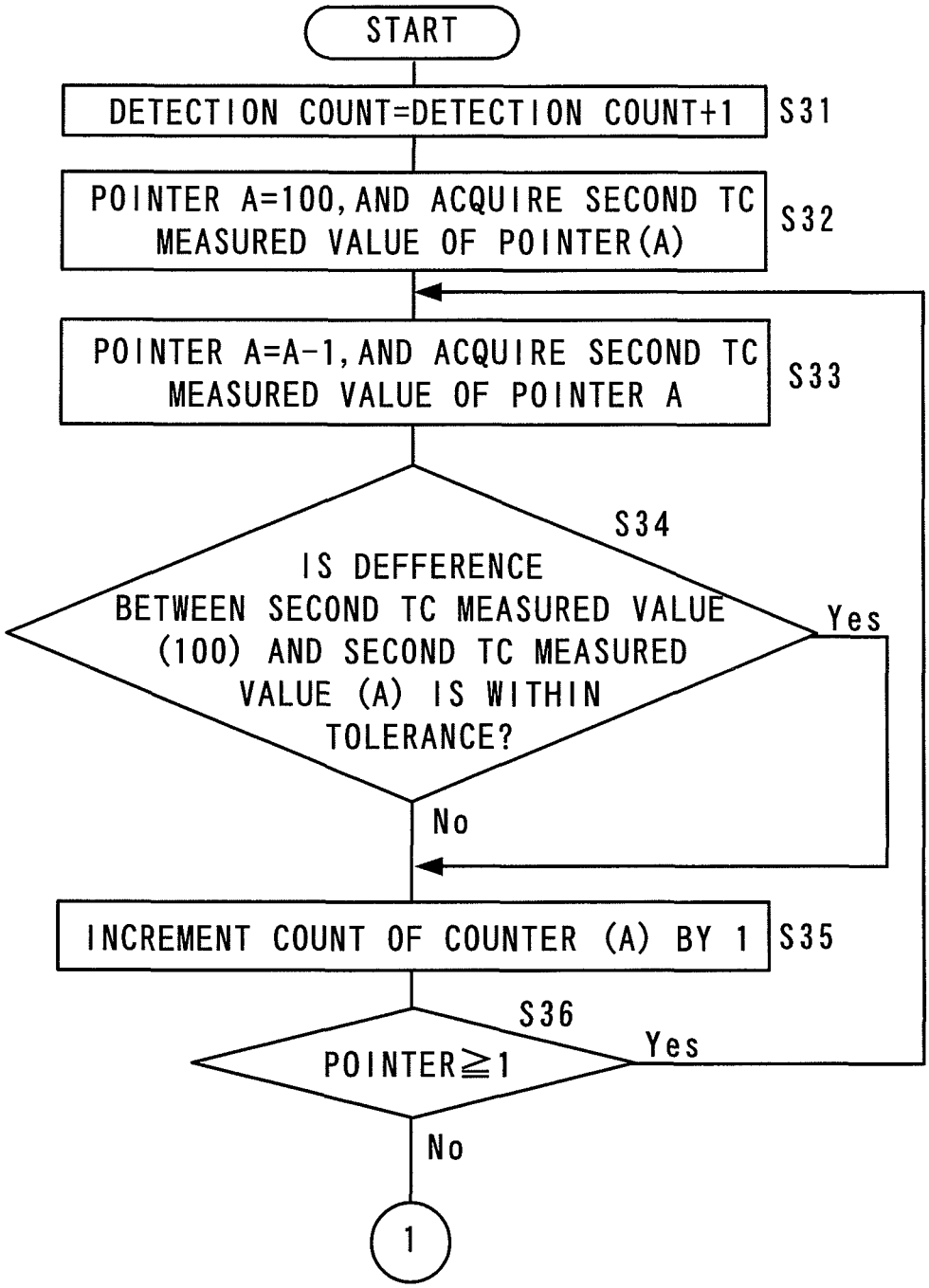
FIG. 7 is a flowchart of the "measurement waiting-time determination processing" subroutine.
Figure 7B:
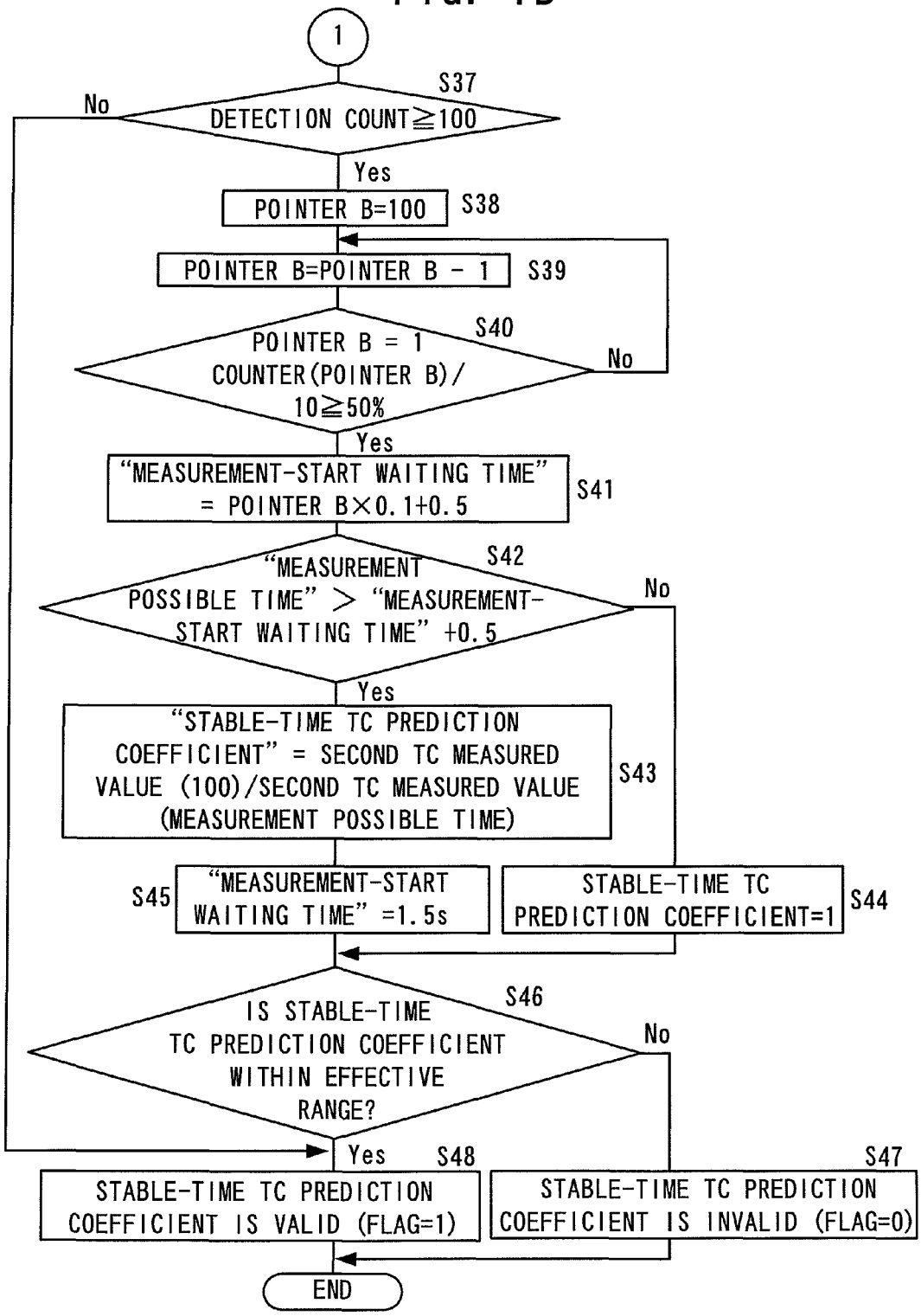

FIG. 7 is a flowchart of the "measurement waiting-time determination processing" subroutine.

In step S31, 1 is added to the "detection count" of the counter that indicates the number of times of the "second TC measured value detection" execution. Incidentally, this "measurement waiting-time determination processing" subroutine determines the "measurement waiting time", but actually, computation and updating of the "measurement waiting time" is performed after this "detection count" reaches 10, in order to increase the sample parameter. Therefore, only the collection of data necessary to determine the "measurement waiting time" is performed up to the "detection count" of nine.

Here, in the storage section 2011 of the controller 201, the pieces of data obtained by the first to 100th sampling in the "second TC measured value detection" is stored. Further, the controller 201 includes a pointer A that indicates an address at which each of these 100 pieces of data is stored.

In step S32, a value 100 is put in this pointer A, and the piece of data by the 100th sampling in the "second TC measured-value group" is acquired. Subsequently, in steps S33 to S36, data values are compared with one another while the value of the pointer A is changed one by one from 99 to 1. In other words, in step S33, 1 is subtracted from the value of the current pointer A, and the data of an address indicated by the current pointer A subjected to the subtraction is acquired. The data obtained by the 100th sampling is assumed to be a value most precisely reflecting the toner quantity of the developing device, in the "second TC measured-value group." Thus, in the next step S34, the data obtained by the 100th sampling is compared with the data stored at the address indicated by the current pointer A, and it is determined whether the difference is within a predetermined tolerance.

Here, a specific comparison between the data obtained by the 100th sampling and the data stored at the address indicated by the current pointer A as well as the tolerance will be described.

Figure 8:
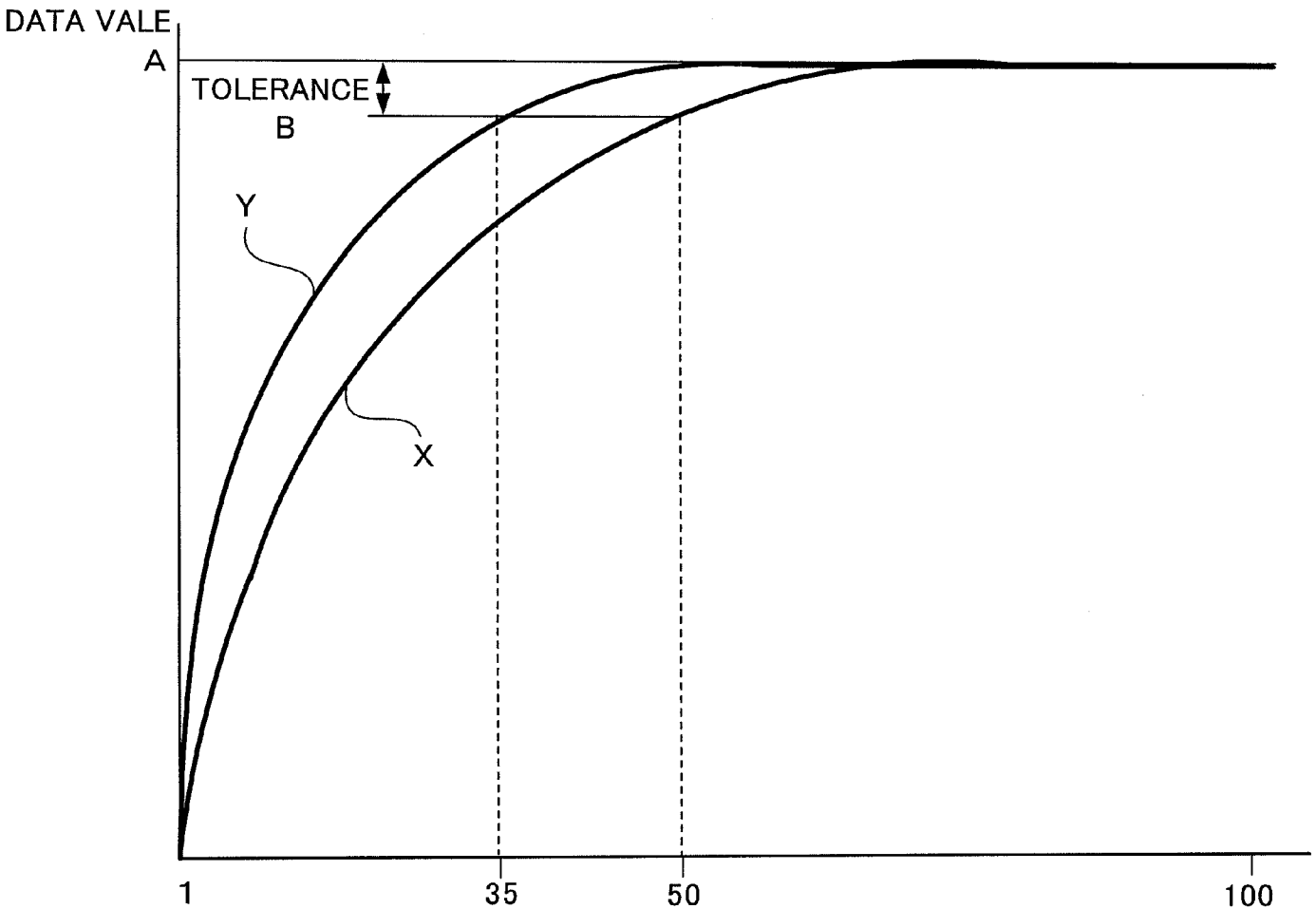
FIG. 8 is a graphical diagram that illustrates an example of the data value obtained by the "second TC measured value detection"

FIG. 8 is a graphical diagram that illustrates an example of the data value obtained by the "second TC measured value detection."

FIG. 8 illustrates the "second TC measured-value group" obtained by the "second TC measured value detection", as a graph in which a horizontal axis represents the first to the 100th detection performed in the "second TC measured value detection", and a vertical axis represents the data value obtained by each detection.

FIG. 8 illustrates a graph X and a graph Y that respectively represent two "second TC measured-value groups" varying in the time required to stabilize the detected value of the permeability sensor 12K. For convenience of description, all the pieces of data obtained in the 100th sampling are assumed to be the same. A tolerance B represents a range in which the detected value may be regarded as being stabilized like that obtained by the 100th detection.

The graph X represents an example in which the detected value is slowly stabilized, and indicates that the data, for which the difference between this data and data A obtained by the 100th detection is in the tolerance B, is the data sampled for of after the 50th time.

On the other hand, the graph Y represents an example in which the detected value is stabilized fast, and indicates that the data, for which the difference between this data and the data A obtained by the 100th detection is in the tolerance B, is the data sampled in the 35th or subsequent sampling. The description will be continued by returning to FIG. 7.

The storage section 2011 of the controller 201 includes 99 counters, and these 99 counters are respectively provided corresponding to the pieces of data obtained by the first to the 99th sampling. In step S35, 1 is added to the count of the counter (A) provided to correspond to the data, for which it is determined that the difference between the data and the data obtained by the 100th sampling is out of the tolerance in step S34 and which is stored at the address indicated by the pointer A. In step S36, it is determined whether the pointer A is equal to or lager than 1, i.e., whether the pointer A has reached 1 by the subtraction from 100. In step S36, when it is determined that the pointer A is equal to or lager than 1, all the comparisons are not yet finished and the flow returns to step S33. On the other hand, when it is determined that the pointer A is less than 1 in step S36, i.e., all the comparisons are finished, the flow proceeds to step S37.

In step S37, it is determined whether the "detection count" has reached 10. In step S37, when it is determined that the "detection count" is less than 10 and further data collection is necessary, this routine ends. On the other hand, when it is determined that the "detection count" has reached 10 in step S37, i.e., the data parameter is sufficient, the flow proceeds to step S38 in order to determine the "measurement waiting time." In each of the 99 counters, 0 or 1 is added to the count value for every count of the "detection count." For example, in a case where it is determined that the difference between the 55th data and the 100th data is out of the tolerance at the time when the "detection count" is 1, 1 is added to the count of the counter (55), and the count value becomes 1. Subsequently, in a case where it is determined that the difference between the 55th data and the 100th data is also out of the tolerance at the time when the "detection count" is 2, 1 is further added to the count of the counter (55), and the count value becomes 2. Thus, the count value of each of the counters (1) to (99) becomes 1 at the maximum and 0 at the minimum.

Here, a specific example of the count value of each of the counters (1) to (99) when the "detection count" reaches 10 will be described.

Figure 9:
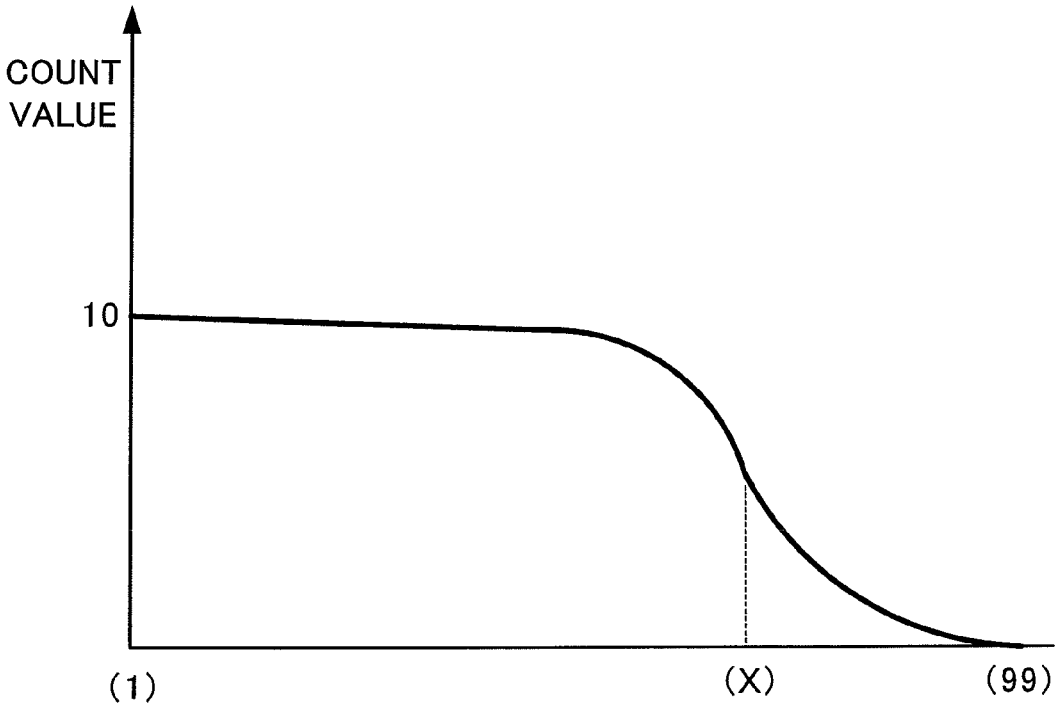
FIG. 9 is a graphical diagram representing the example of the count value.

FIG. 9 is a graphical diagram representing the example of the count value.

FIG. 9 illustrates, in the form of graph, the count value of each of the counters (1) to (99) commonly used, for the ten "second TC measured-value groups" obtained in the "second TC measured value detection" performed 10 times. A horizontal axis in FIG. 9 represents the number X of each counter, and the vertical axis represents the count value.

FIG. 9 illustrates a state in which as the number X increases, the count value of the counter (X) decreases gradually. FIG. 9 also indicates that a large decrease occurs in the course of the increase of the number X. It is conceivable that the detected value may be stabilized at the time when such a large decrease occurs.

In the following, the description will be continued, assuming that the data as illustrated in FIG. 9 is acquired based on the ten "second TC measured-value groups" obtained by the "second TC measured value detection" performed 10 times, and also assuming that a pointer B indicating each of these counters (1) to (99) is provided. When the value of this pointer B is 1, this pointer B indicates the counter (1). By returning to FIG. 7, the description will be continued, starting from step S38.

In step S38, the value of the pointer B of the counter is caused to be 100. Subsequently, in step S39, 1 is subtracted from the value of the current pointer B, and in the next step S40, the count value of the counter corresponding to the value of the pointer B is acquired. Subsequently, in step S40, it is determined whether an operational result (this will be hereinafter referred to as "NG rate") of dividing the acquired count value by the "detection count" (here, 10) corresponding to the maximum count value is equal to or higher than an acceptable NG rate (for example, 50%). Now, this acceptable NG rate will be described.

Figure 10:
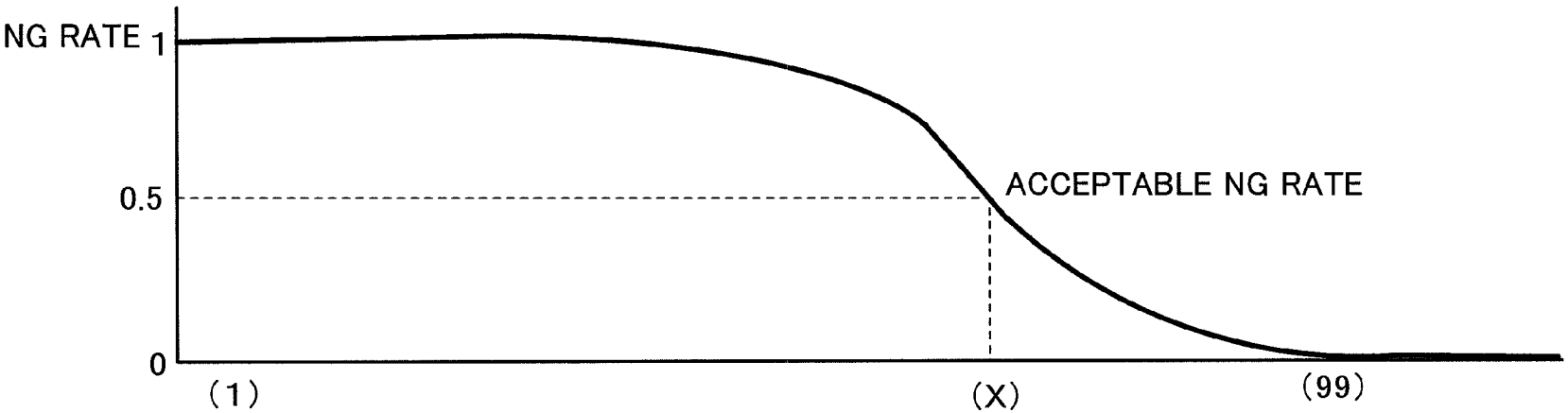
FIG. 10 is a graph representing the NG rate.

FIG. 10 is a graph representing the NG rate.

FIG. 10 illustrates the graph in which a horizontal axis represents the counters (1) to (99), and a vertical axis represents the value (NG rate) obtained by dividing the count value of each counter by 10. FIG. 10 indicates that the counter having the NG rate exceeding the acceptable NG rate of 50% is from the counter (X) to the counter (1). The counter with the NG rate exceeding 50% is a counter for which it is determined that in more than half of the "second TC measured value detection" performed 10 times, the detected value is not stabilized. In other words, this means that at the detection time corresponding to the counter exceeding the acceptable NG rate of 50%, the stirring of the developer is not yet stabilized. In step S40 of FIG. 7, when the value of the pointer B for the counter is subtracted from 99 and X in the example of FIG. 10 is achieved, the flow proceeds to step S41. Further, in step S40, it is determined whether the pointer B for the counter is 1 or not. This is because when the NG rate does not exceed 50% even if the subtraction for the pointer B is performed up to 1 in step S39, i.e., even if checking is performed up to the counter (1), the flow exits from step S40.

In step S41 of FIG. 7, the value, which is obtained by multiplying the value of the pointer B indicating the counter (X) with the acceptable NG rate exceeding 50% by 0.1 (see step S17 of FIG. 6) that is the time between the measurements of the "second TC measured value detection", and to which 0.5 s (see step S16 of FIG. 6) that is the measurement waiting time of the "second TC measured value detection" is added, is provided as the "measurement-start waiting time." This "measurement-start waiting time" represents the time most suitable for the current environment and required to stabilize the state of the developer at the minimum. This "measurement-start waiting time" is recorded as an update in the storage section 2011 of the controller 201. This controller 201 is equivalent to an example of the period setting device according to the aspect of the present invention. Further, this "measurement-start waiting time" is equivalent to an example for the result stable time according to the aspect of the present invention.

In step S42, it is determined whether the time, which is obtained by adding 0.5 s (see step S3 of FIG. 4) required to perform the "first TC measurement processing" at least once to this "measurement-start waiting time", is shorter than the time during which the development roll 10K for the K color is allowed to face the photoreceptor roll 100 at the time of forming the full color image (this time will be hereinafter referred to as "measurement possible time"). In other words, it is determined whether the "measurement-start waiting time" determined by the computation in step S41 is sufficiently long to the extent that the "first TC measurement processing" is not performed even once. Incidentally, in this printer 10, the "measurement possible time" is, for example, 2S. This "measurement possible time" is equivalent to an example of the first running duration according to the aspect of the present invention.

The most suitable "measurement-start waiting time" changes depending on the temperature and humidity, the amount of the developer, and the like and therefore, in the foregoing, the description has been provided mainly about the computation and updating of the "measurement-start waiting time" most suitable for the current environment. However, it is expected that there may be a case where the newly determined "measurement-start waiting time" is set to be long to the extent that the "first TC measurement processing" may not be performed even once.

When it is determined in step S42 that the "first TC measurement processing" may not be performed even once, the flow proceeds to step S43. In step S43, among the first to the 100th data obtained in the "second TC measured value detection" performed immediately before, the data (hereinafter referred to as "corresponding data") obtained by the sampling performed after the lapse of the "measurement possible time" subsequent to the initiation of this "second TC measured value detection" is acquired. Further, the 100th data obtained in the same "second TC measured value detection" is acquired. Subsequently, a value obtained by dividing this 100th data by this corresponding data is stored in the storage section 2011 as a "stable-time TC prediction coefficient."

In step S45, the current "measurement-start waiting time" in which the "first TC measurement treatment" may not be performed even once is changed to 1.5 s that is the default of "measurement-start waiting time" enabling the "first TC measurement processing" to be performed once, and stored in the storage section 2011 (see FIG. 3). Subsequently, the flow proceeds to step S46.

The computation of the "stable-time TC prediction coefficient" will be described by taking a specific example.

Figure 11:
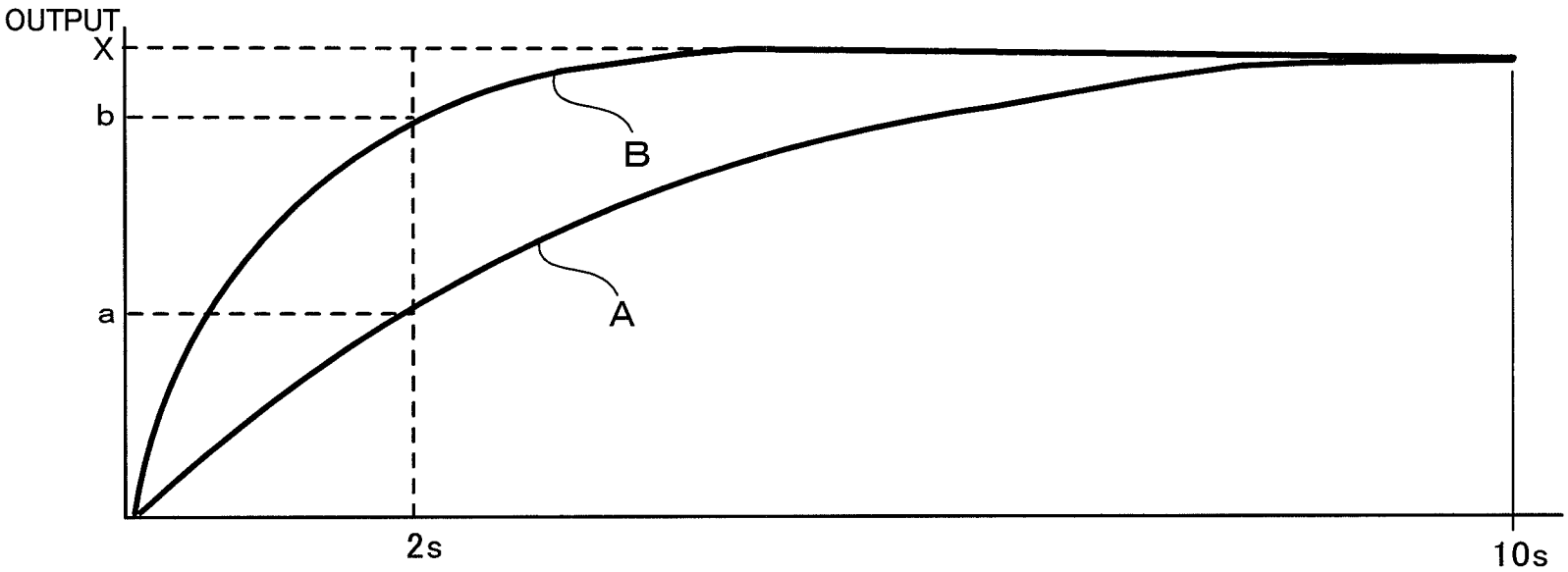
FIG. 11 is a graphical diagram that illustrates the data obtained by the "second TC measured value detection"

FIG. 11 is a graphical diagram that illustrates the data obtained by the "second TC measured value detection."

FIG. 11 illustrates two examples of the data of two patterns being obtained by the latest "second TC measured value detection", as graphs A and B, respectively. Here, a horizontal axis represents a duration (about 10 s) required to carry out the "second TC measured value detection" in which the detection is performed 100 times at 0.1-second intervals, and a vertical axis represents the obtained data value. This duration (about 10 s) of the "second TC measured value detection" is equivalent to an example of the second running duration according to the aspect of the present invention.

First, in the graph A, an output value a is obtained during the time corresponding to the "measurement possible time", and an output value X is obtained by the 100th detection. Thus, when the latest "second TC measured value detection" is the data illustrated by the graph A, the "stable-time TC prediction coefficient" is X/a.

Further, in the graph B, an output value b is obtained during the time corresponding to the "measurement possible time", and an output value X is obtained by the 100th detection. Thus, when the latest "second TC measured value detection" is the data illustrated in the graph B, the "stable-time TC prediction coefficient" is X/b.

By the stable-time TC prediction coefficient calculated in this way, the output value, which is obtained by the "first IC measurement processing" that may be performed only once because the "measurement-start waiting time" is set to the default of 1.5 in step S45, is multiplied. The result of this multiplication is expected to be obtained as the 100th sampling data if the "second TC measured value detection" is performed, and it is expected that prediction accuracy is sufficiently high. By returning to step S42 of FIG. 7, the description will be continued.

When it is determined in step S42 that the sampling may be performed at least once during the "measurement possible time", the "stable-time TC prediction coefficient" is set to 1 in step S44, and the flow proceeds to step S46.

In step S46, it is determined whether the "stable-time IC prediction coefficient" obtained in step S43 falls within an effective range. When it is determined that the "stable-time IC prediction coefficient" falls within the effective range in step S46, that is, when the "stable-time TC prediction coefficient" is small like the graph B of the example in FIG. 11, a change in or after 2 s is small, and it is conceivable that the prediction is very likely to be appropriate, the flow proceeds to step S48 where a flag (the value is 1) indicating that the "stable-time TC prediction coefficient" is effective is stored in the storage section 2011. Subsequently, although the details will be described later, the toner replenishing is performed based on the predicted value of predicting the toner density at the time of being in a stable condition.

On the other hand, when it is determined that the "stable-time TC prediction coefficient" is out of the effective range in step S46, that is, when it is conceivable that the "stable-time TC prediction coefficient" may be large like the graph A of the example in FIG. 11, and the prediction is very likely to be inappropriate because a change in or after 2 s is large, the flow proceeds to step S47 where a flag (the value is 0) indicating that the "stable-time TC prediction coefficient" is invalid is stored in the storage section 2011. In this case, although the details will be described later, the toner replenishing relies on the replenishing (see step S18 of FIG. 6) in the "second TC measurement processing." Subsequently, this subroutine is finished, and the flow returns to step S19 of FIG. 6.

Lastly, the "developer replenishing processing" subroutine will be described.

In this printer 10, this subroutine is executed in both of step S4 of FIG. 4 in the "first TC measurement processing" and step S18 of FIG. 6 in the "second TC measurement processing."

Figure 12:
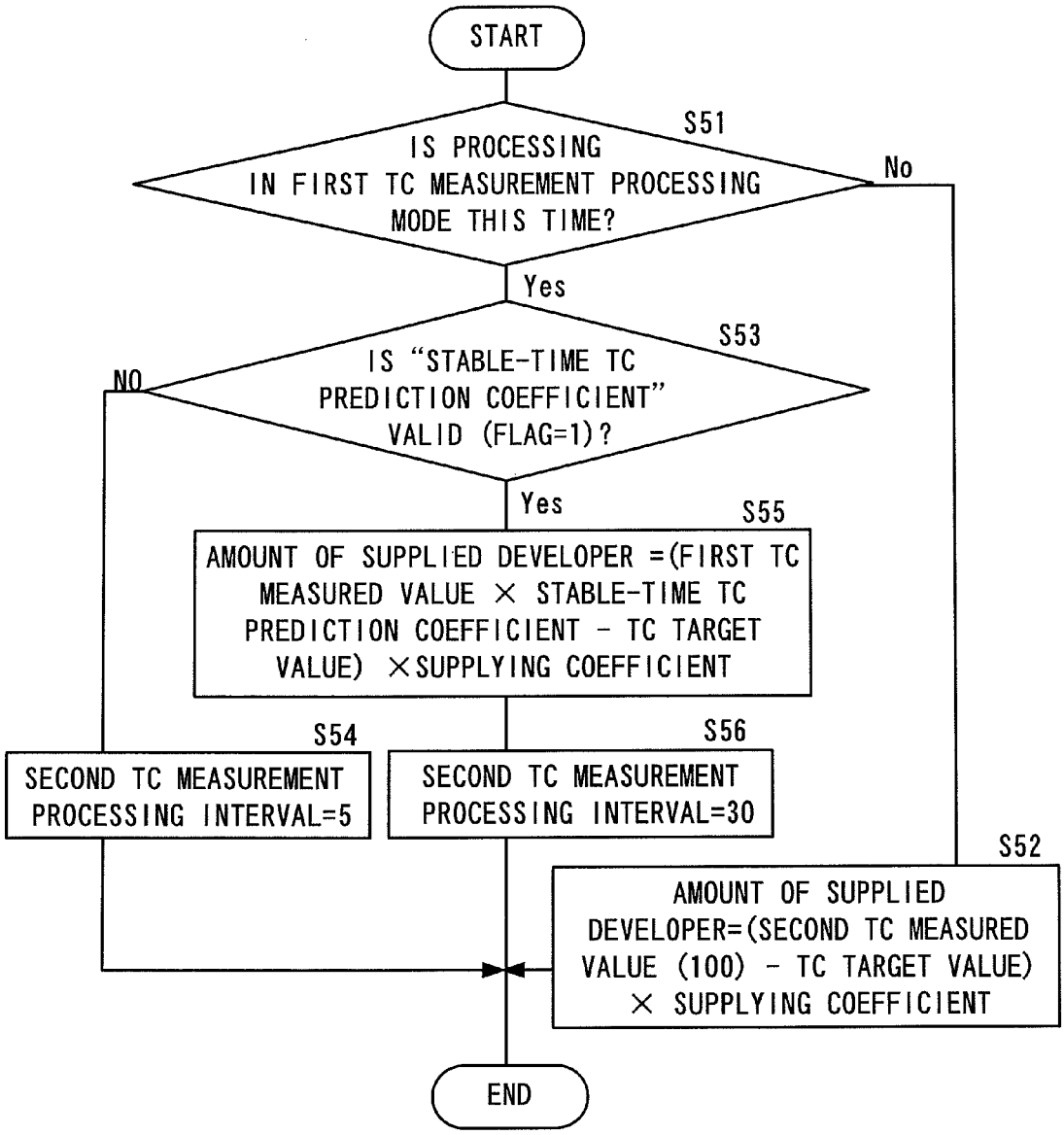
FIG. 12 is a flowchart of the "developer replenishing processing" subroutine.

FIG. 12 is a flowchart of the "developer replenishing processing" subroutine.

In step S51 illustrated in FIG. 12, it is determined whether the developer replenishing processing is in either the "first TC measurement processing" or the "second TC measurement processing." When it is determined in step S51 that the developer replenishing processing is in the "second TC measurement processing", the flow proceeds to step S52. In step S52, a TC target value is subtracted from the data value obtained by the 100th sampling in the latest "second TC measured value detection", and the result of the subtraction is multiplied by a replenishing coefficient and thereby an amount of supply is determined. Subsequently, the K-color toner is supplied by only the determined amount of supply. In this way, in the "second TC measurement processing", the data value obtained in the 100th sampling in which the detected value is sufficiently stabilized is used and thus, accuracy of the toner replenishing is high. On the other hand, when it is determined in step S51 that the developer replenishing processing is in the "first TC measurement processing", the flow proceeds to step S53. In step S53, it is determined whether the "stable-time IC prediction coefficient" currently stored in the storage section 2011 is valid. When it is determined in step S53 that the "stable-time TC prediction coefficient" is invalid, the toner replenishing during the "first TC measurement processing" is not performed. In other words, the toner replenishing relies on the replenishing processing from the "second TC measurement processing." However, the value of the "second TC measurement processing interval" in step S13 of FIG. 6 is changed from 30 to 5 so that the "second TC measured value detection" set to be performed every time 30 sheets are printed may be performed every time 5 sheets are printed, and thereby accuracy of the toner density control is improved.

On the other hand, when it is determined in step S53 that the "stable-time IC prediction coefficient" is valid, the flow proceeds to step S55. In step S55, the difference between the result of multiplying the data obtained in the "first TC measurement processing" by the "stable-time TC prediction coefficient" and the target value is multiplied by the replenishing coefficient, and thereby the amount of supply is determined. Subsequently, the K-color toner is supplied by only the determined amount of supply. Here, in a case where the "stable time TC forecast count" is 1, this case means that actually, the predicted value is not used, but the detected value itself stabilized (reached the stability) during the "first TC measurement processing" performed for a shot time is used, and highly precise toner control is obtained. Further, also in a case where the "stable-time IC prediction coefficient" is not 1, the detected value when stable is predicted with high accuracy as described above and thus, the accuracy of the toner control is sufficiently high as well. Subsequently, in step S56, if the "second IC measurement processing interval" becomes 5 by then, assuming that determination of the amount of to-be-supplied developer based on the "first TC measurement processing" is possible at present, the "second TC measurement processing interval" is returned to 30, and this subroutine ends.

In the above-described exemplary embodiment, the revolver developing unit having the image-forming devices according to an aspect of the invention is taken as an example of the image forming apparatus according to an aspect of the invention. However, the image forming apparatus according to an aspect of the invention is not limited to this example, and may be a monochrome printer including only a developing device for the K color.

Further, in the above-described exemplary embodiment, the case in which the detection is performed 100 times is taken as an example of the detection executed plural times by the detector over the second running duration according to the aspect of the present invention, but the plural times according to the aspect of the present invention is not limited to 100 times. Further, the second running duration according to the aspect of the present invention is not limited to about 10 seconds and may only need to be longer than the first running duration.

Furthermore, in the above-described exemplary embodiment, the example in which the second running duration according to the aspect of the present invention is secured every time the operation of printing 30 sheets is finished is described. However, the second running duration according to the aspect of the present invention may only need to be a period during which the stirring of the toner is performed for a time longer than the first running duration. For example, in a printer that makes an image adjustment regularly, the second running duration according to the aspect of the present invention may be secured as a period during which toner stirring and image formation are performed at the time of this regularly executed image adjustment, or may be irregularly secured after printing operation ends or at the time of image adjustment.

In the above-described exemplary embodiment, the printer is taken as an example of the image forming apparatus according to the aspect of the present invention. However, the image forming apparatus according to the aspect of the present invention is not limited to the printer and may be a copying machine or a facsimile that forms images based on data read by an image reader.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment is chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier on a surface of which an image is formed and carries the image;

an image-forming device that includes a toner, forms a toner image on the surface of the image carrier with the toner while stirring the toner inside the image-forming device, performs forming the toner image within a first running duration, and stops forming the toner image and stirring the toner after the first running duration;

a detector that is attached to the image-forming device, detects a quantity of the toner included in the image-forming device within the first running duration, is set with a first period of detection within the first running duration, and performs detection during the first period which is set;

a toner supplying device that supplies the image-forming device with a quantity of toner according to the quantity of the toner detected by the detector; and a period setting device that causes the image-forming device to stir the toner over a second running duration longer than the first running duration, and causes, during the second running duration, the detector to perform the detection a plurality of times over a second period longer than the first period, to measure a result stable time required for a result of the detection by the detector to stabilize, and to set in the detector, as the first period of the detection within the first running duration, a stable period over which the result of the detection is stable within the first running duration.

2. The image forming apparatus according to claim 1, further comprising:

a plurality of the image formation devices; and a rotation device that rotates while causing one image-forming device among the plurality of the image-forming devices to face the surface of the image carrier to form the toner image during the first running duration, to replace the facing image-forming device.

3. The image forming apparatus according to claim 1, wherein even when stable period is yet to arrive within the first running duration, the period setting device sets in the detector a period within the first running duration as the period of the detection, and when the result stable time is yet to arrive within the first running duration, the toner supplying device estimates, based on the quantity of the toner detected by the detector, a detected quantity at the time when the result of the detection is stable, and supplies the image-forming device with a quantity of toner according to the estimated detected quantity.

4. The image forming apparatus according to claim 1, wherein when the stable period is yet to arrive within the first running duration, the toner supplying device supplies the image-forming device with a toner in a quantity corresponding to the quantity of the toner detected by the detector after a lapse of the stable period, the quantity of the toner being obtained when the stable period is measured in the period setting device.

5. The image forming apparatus according to claim 4, wherein when the stable period is yet to arrive within the first running duration, the period setting device increases a frequency of measuring the stable period.

* * * * *